United States Patent [19]

Ray et al.

[11] 4,316,579

[45] Feb. 23, 1982

[54] MULTI-PURPOSE SEAL FOR POP-UP SPRINKLER

[75] Inventors: Charles A. Ray, Arcadia; John L. Kent, Ontario, both of Calif.

[73] Assignee: Anthony Manufacturing Company, Azusa, Calif.

[21] Appl. No.: 138,868

[22] Filed: Apr. 11, 1980

[51] Int. Cl.[3] ..... B05B 15/10

[52] U.S. Cl. ..... 239/123; 239/205; 239/206; 277/24; 277/27; 277/152; 285/110; 285/302

[58] Field of Search ..... 239/104, 106, 114, 115, 239/123, 203–206; 277/3, 24, 27, 152; 285/110, 302

[56] References Cited

U.S. PATENT DOCUMENTS 2,066,008 12/1936 Knoerzer ..... 285/110 X 3,921,910 11/1975 Hayes et al. ..... 239/205

*Primary Examiner*—Andres Kashnikow

*Attorney, Agent, or Firm*—Fulwider, Patton, Rieber, Lee and Utecht

[57] ABSTRACT

For use with a pop-up sprinkler of the full or part circle type, a multi-purpose seal is provided between the movable stem of the pop-up sprinkler and a stationary mounting base which is fixed with respect to the sprinkler housing. The seal is preferably a unitary molded article and includes a grit wiper at its upper end, a central bearing to slidingly guide the stem within the housing, a sliding water-activated seal, and an annular static seal for providing a watertight seal between the movable stem and stationary housing during normal operation of the sprinkler.

22 Claims, 7 Drawing Figures

Fig. 1
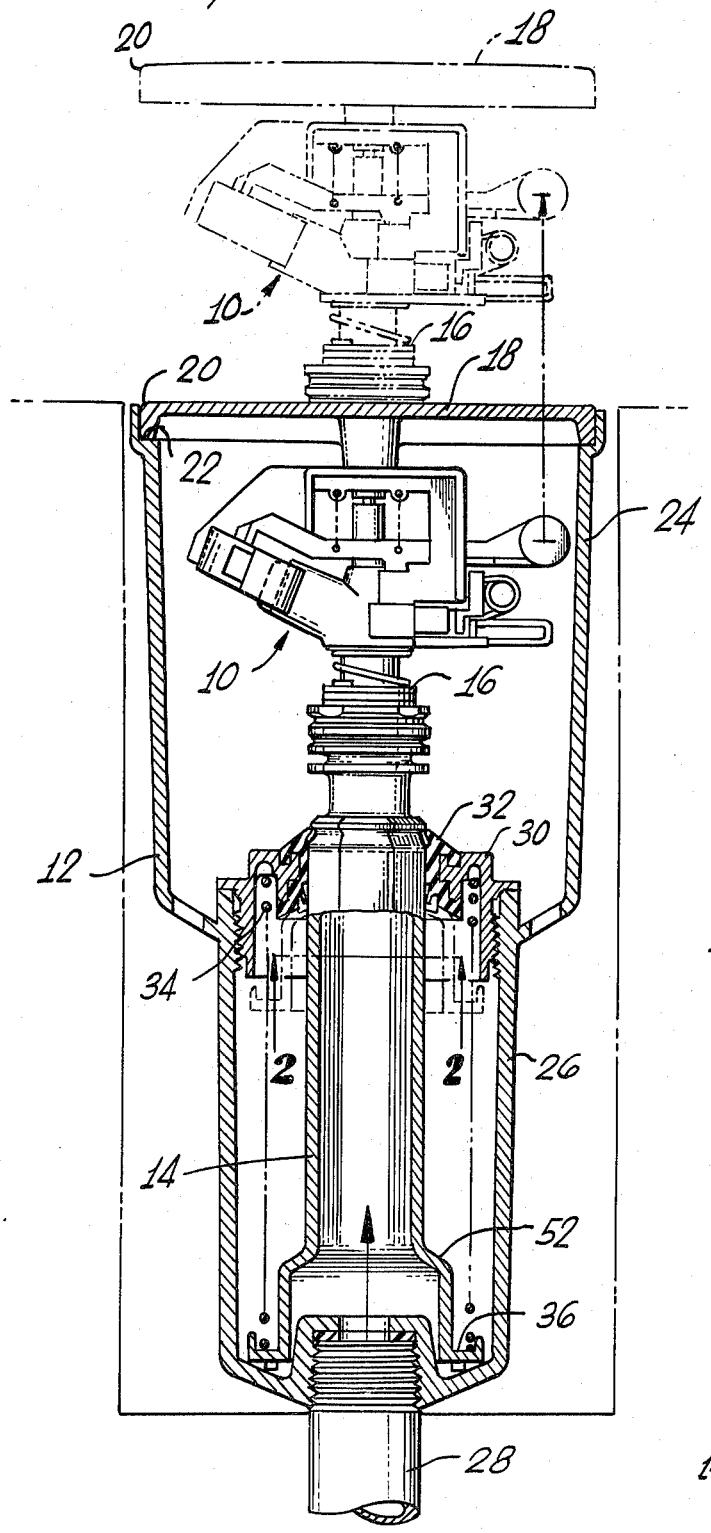
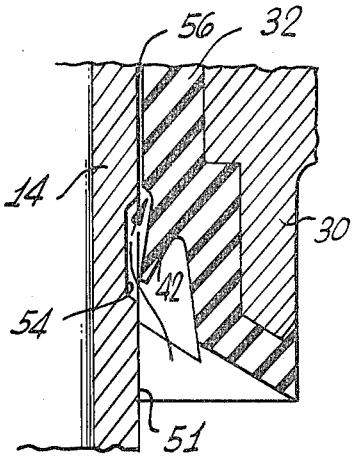
Fig. 3
Fig. 2
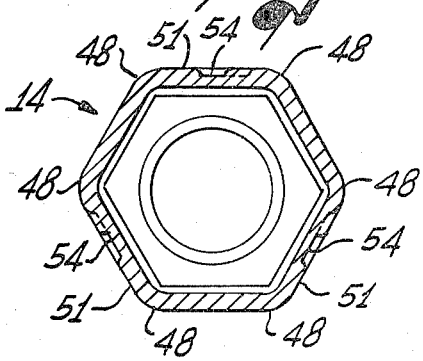
Fig. 4
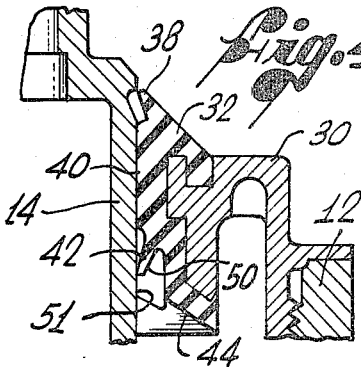

MULTI-PURPOSE SEAL FOR POP-UP SPRINKLER

BACKGROUND OF THE INVENTION

This invention relates generally to irrigation sprinklers of the pop-up type, and, more particularly, to a seal for such a sprinkler which is interposed between the vertically movable sprinkler stem and a stationary mounting base whish is fixed with respect to the sprinkler housing.

During operation of a pop-up type sprinkler, it is necessary to provide an adequate seal between the movable stem and mounting base to prevent irrigation water from leaking between the stem and mounting base and flooding the subterranean housing or the area immediately surrounding the sprinkler. However, in order to ensure reliable operation of the pop-up and pop-down mechanism in a pop-up type sprinkler, it is also necessary that the stem remain freely movable between its extended and retracted positions. It will be appreciated that when a tight sliding seal is provided to accomplish both of these ends, any grit or other foreign material that might get deposited on the stem can cause the stem to bind in the seal and inhibit reliable operation of the pop-up and pop-down mechanism.

Further, when the pop-up mechanism is intended for use with a part-circle type of sprinkler, it is also necessary to provide a means for preventing the stem from rotating with respect to housing. Previously this has been accomplished by providing a cylindrical stem with a longitudinal key which cooperates with a keyway in the mounting base. Although this arrangement satisfactorily prevents relative rotation, the keyway makes it difficult to provide an adequate seal between the stem and mounting base, and undesirable leakage occasionally results.

Accordingly, there exists a need for a convenient, effective, and economical seal which can be interposed between the movable stem of a pop-up sprinkler and the stationary base on which it is mounted, and which is capable of providing a water-tight seal when in operation and is self-cleaning to provide reliable operation over a long period of time. As will become apparent from the following, the present invention satisfies that need.

SUMMARY OF THE INVENTION

The present invention resides in a new and improved seal for a pop-up type sprinkler which cooperates with both the mounting base of the sprinkler housing and the movable stem of the pop-up sprinkler to provide a watertight seal during operation of the sprinkler and during vertical movement of the sprinkler between its extended and retracted positions. This is accomplished generally by providing a unitary seal which includes a grit wiper at its upper end, a central bearing portion, a sliding water-activated seal and an annular static seal around the lower portion thereof.

More specifically, the seal of the present invention is preferably molded as a unitary article and can be molded in place on the mounting base of the sprinkler housing for cooperation with the movable stem of the sprinkler, thereby greatly simplifying the assembly of the pop-up sprinkler. To prevent relative rotation between the stem and base, the stem is preferably formed in a polygonal shape, such as a hexagon, and of course, the central aperture through the base and seal is also hexagonal to cooperate with the stem.

The grit wiper at the upper end of the seal is formed of an upwardly directed lip which surrounds the polygonal stem and scrapes the stem clean during pop-down of the stem. The central bearing portion includes a plurality of raised pads to guide and contact the stem without bearing against the entire periphery of the stem.

The sliding water-activated seal is positioned adjacent the lower end of the seal, surrounds the stem, and is formed of a downwardly directed lip conforming to the polygonal shape of the stem. This lip is pressed into engagement with the stem by water pressure during pop-up movement of the stem.

The annular static seal is formed at the lower-most portion of the stem, and unlike the rest of the seal, is preferably conical and matches with a similarly conical portion of the pop-up stem when the stem is at its fully extended upward position. With this arrangement, the annular static seal will ensure full sealing contact with the stem regardless of minor dimensional variances within permitted manufacturing tolerances. It will be appreciated that the combination of the polygonal sliding seal and the conical static seal provides improved sealing engagement between the moveable stem and mounting base over that which is possible with a conventional key and keyway arrangement.

In accordance with a further feature of the invention, the pop-up stem can be provided with one or more by-pass slots which permit water to flow momentarily around the sliding water-activated seal during the pop-up stroke of the stem and flush any grit or other foreign material out of the upper portion of the seal. This flushing action cleans grit off of the grit wiper at the upper end of the seal so that it can function satisfactorily during the next down stroke of the pop-up stem.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is an elevational view, partly in section, of a pop-up type sprinkler having a seal embodying the present invention, shown in full line in a retracted position within a subterranean housing, and shown in phantom line in a vertically extended position for normal operation;

FIG. 2 is an enlarged sectional view taken substantially along line 2—2 of FIG. 1, and illustrating the polygonal shape of the pop-up stem and location of the by-pass slots thereon;

FIG. 3 is a further enlarged, fragmentary, elevational section illustrating the cooperation of the seal of FIG. 1 with the by-pass slots illustrated in FIG. 2;

FIG. 4 is an enlarged, fragmentary, sectional view of the seal of FIG. 1, and illustrating its cooperation with the mounting base and pop-up stem with the stem in its fully retracted position;

DETAILED DESCRIPTION

Figure 5:
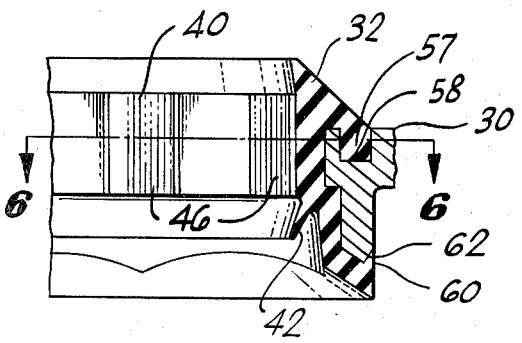
FIG. 5 is an enlarged, fragmentary, sectional view of the seal of FIG. 1, shown with the stem removed to illustrate the configuration of the inner surface of the central bearing portion of the seal.

As shown in the exemplary drawings, the present invention is embodied in an irrigation sprinkler 10 of the pop-up type which is intended to be retracted within a subterranean housing 12 when not in use, as shown in full line in FIG. 1, and extended above the housing 12 when in use, as shown in phantom line in FIG. 1. In this instance, the sprinkler 10 is of the impact drive type and is mounted on the upper portion of a pop-up stem 14 which reciprocates vertically within the housing to move the sprinkler between its operating and retracted positions.

To permit relative rotation between the sprinkler 10 and the pop-up stem 14, the sprinkler is coupled to the stem through a bearing 16 of conventional design. A disc-shaped cover plate 18 overlies the sprinkler 10, and when the stem 14 and sprinkler are retracted into the housing 12, the rim 20 of the cover plate fits within a lip 22 formed around the inside upper end of the housing to fully enclose the sprinkler 10 within the housing when not in use.

The housing 12 is comprised generally of two main portions, an upper sprinkler-enclosing portion 24 and a lower pop-up cylinder portion 26; and the entire housing 12 is mounted in a stationary position below ground level by being secured at its lower end to a stationary water supply pipe 28. For the purpose of guiding the pop-up stem 14 between its operating and retracted positions and for providing a seal between the upper and lower portions of the housing 12, a mounting base 30 is secured to the housing between the upper and lower portions of the housing, and the mounting base 30 carries a seal 32 which cooperates with the stem 14, as will be described in greater detail below.

To hold the sprinkler in its retracted position when not in use, a coil spring 34 is arranged between the underside of the stationary mounting base 30 and a radial flange 36 at the bottom of the stem 14. To begin operation of the sprinkler 10, water under pressure is introduced into the housing 12 through the supply pipe 28, and the water pressure causes the stem 14 to move upwardly against the force of the spring 34 until the sprinkler is in the operating position shown in phantom line in FIG. 1. Continued supply of water from the supply pipe 28 will cause the impact drive sprinkler 10 to operate in a manner well known in the art. When the supply of water from the supply pipe 28 ceases, the coil spring 34 will again force the pop-up stem 14 downwardly to the position shown in full line in FIG. 1, and the sprinkler 10 will be safely enclosed within the upper portion 24 of the housing 12.

In accordance with the present invention, the seal 32 provided between the pop-up stem 14 and the stationary mounting base 30 is a unique unitary device capable of simultaneously performing a plurality of useful functions. More specifically, the seal 32 includes a grit wiper 38 (FIG. 4) at its upper end which scrapes the stem clean during pop-down of the stem, a central bearing 40 to slidingly guide the stem and keep the stem and sprinkler centered in the housing 12 and mounting base 30, a sliding water-activated seal 42 for sealing against the stem during pop-up operation, and an annular static seal 44 for providing a positive, watertight seal between the movable stem and stationary housing during normal operation of the sprinkler 10.

The grit wiper 38 is comprised of an upwardly and inwardly directed lip formed around the periphery of the upper end of the seal 32. During pop-down of the stem, the grit wiper 38 scrapes any grit or other foreign matter which may have accumulated on the stem during operation of the sprinkler off of the stem, thereby keeping such foreign matter out of the central bearing 40.

To guide the pop-up stem 14 between its operating and retracted positions, the central bearing 40 is sized and shaped to slidingly surround the stem 14. When the sprinkler 10 is intended for part circle use, it is necessary that the pop-up stem 14 be prevented from rotating with respect to the housing 12, and for this purpose the stem 14 and bearing 40 are preferably polygonal, such as hexagonal as shown, for example, in FIGS. 2 and 6.

Figure 6:
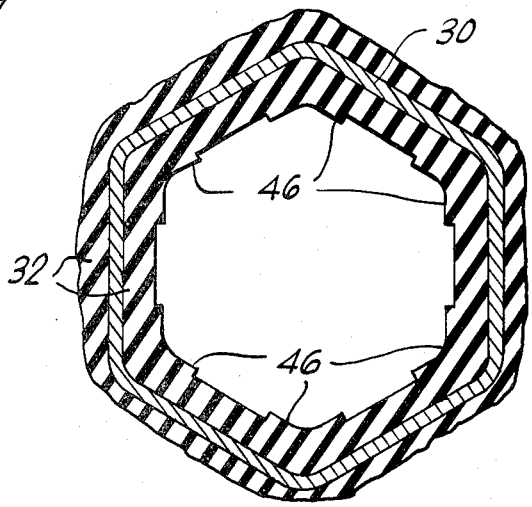
FIG. 6 is an enlarged, fragmentary, sectional view taken generally along line 6—6 of FIG. 5, and illustrating the location of the raised pads of the central bearing portion of the seal.

In a preferred embodiment shown in FIG. 6, the central bearing 40 includes a plurality of raised pads 46 which contact the stem 14, and in this instance, the pads are located at the corners of the hexagonal bearing 40 and will therefore contact and guide the stem 14 along the corners 48 thereof. By not contacting the stem around its entire periphery, the bearing 40 permits relatively free axial movement of the stem 14 between its operating and retracted positions, as well as enhancing a self-cleaning feature which will be described in greater detail below.

In order to provide a seal to prevent water from leaking from the lower portion 26 of the housing 12 to the upper portion 24 during the pop-up operation of the stem, the water-activated seal 42 is comprised of a relatively thin, downwardly and inwardly extending lip disposed below the central bearing 40 and sized and shaped to conform to the exterior wall 51 of the stem 14. With this arrangement, during pop-up of the stem 14, water pressure will be exerted against the outer surface 50 (FIG. 4) of the seal 42 and urge the seal into sliding engagement with the wall 51 of the stem 14.

When the stem 14 reaches its fully extended upward position, as shown in phantom line in FIG. 1, a generally conical shoulder 52 near the lower end of the stem 14 is pressed into contact with the annular static seal 44 on the seal 32. The static seal 44 is also generally conical, rather than polygonal like the rest of the seal 32, thereby ensuring formation of a positive, watertight seal between the stem 14 and seal 32 during normal operation of the sprinkler 10 regardless of minor dimensional variances within permitted manufacturing tolerances.

If desired, of course, the stem 14 and seal 32 can be circular instead of polygonal, and an external guiding device such as a key and keyway (not shown) can be used to prevent rotation of the stem. In this case, the grit wiper 38, bearing 40 and water-activated seal 42 are circular, and the static seal 44 remains generally conical in shape.

In accordance with a further feature of the present invention, a provision can be made to cause the stem 14 and seal 32 to be self-cleaning during the pop-up stroke of the stem. This can be accomplished by providing one or more slots 54 in the wall 51 of the stem, as can best be seen in FIGS. 2, 3 and 7.

As described above, during pop-up of the stem 14 the water-activated seal 44 bears against the wall 51 of the stem to prevent water from leaking past the seal 32. However, since the seal 42 is sized and shaped to conform to the exterior wall 51 of the stem, as the slot 54 moves past the seal 42, the seal 42 does not seat in the bottom of the slot 54, and some water will be permitted to flow past the seal 42 as indicated by the arrow in FIG. 3.

As can further be seen in FIGS. 3 and 6, the slots 54 are preferably aligned with the gaps between the pads 46 in the central bearing 40, and accordingly, a slight clearance 56 (FIG. 3) exists between the wall 51 of the stem and the central bearing 40 above the slot. This clearance permits the water that flows through the slot 54 to flow upwardly toward the grit wiper 38 and flush any grit or other foreign material off of the grit wiper 38 so that it will be in a clean condition fo performing its grit wiping function during the next down stroke of the stem 14.

Figure 7:
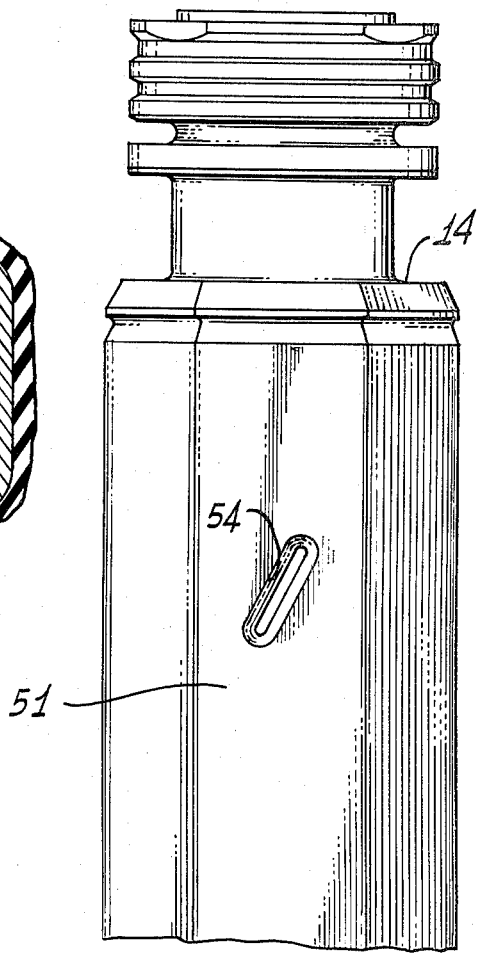
FIG. 7 is an enlarged, fragmentary, elevational view of the pop-up stem, illustrating the location and orientation of one of the by-pass slots in the stem.

It will be appreciated that only a small amount of water is permitted to leak past the seal 42 to accomplish this self-cleaning action, because the cleaning water flows only while the slot 54 passes under the seal 42. If desired, the slot 54 can be oriented obliquely to the axis of the stem 14, as shown in FIG. 7, thereby imparting a swirling motion to the cleaning water and enhancing the self-cleaning action of the device.

The seal 32 can be secured to the mounting base 30 in any suitable manner, but in the preferred embodiment illustrated, it is molded in place on the mounting base. In this instance, to ensure that the seal 32 is held firmly in place, a downwardly extending tongue 57 on the seal 32 is molded into an annular groove 58 in the mounting base 30 (FIG. 5), and an annular flange 60 on the seal 32 is molded over an outwardly facing bevel 62 on the mounting base.

From the foregoing it will be appreciated that the seal 32 of the present invention provides a single device which can be interposed between the pop-up stem 14 and housing 12 of a pop-up type sprinker 10, and which is capable of performing a plurality of functions which heretofore were performed, if at all, by separate devices. Moreover, when the seal 32 is molded in place on the mounting base 30 as in the preferred embodiment disclosed herein, the seal 32 provides a pop-up sprinkler 10 that can be assembled easily and therefore is convenient and economical to manufacture.

While a particular form of the invention has been illustrated and described, it will be apparent that various modifications can be made without departing from the spirit and scope of the invention.

We claim:

1. In combination with a pop-up type irrigation sprinkler having a generally stationary housing and a pop-up stem arranged for reciprocation in said housing, a seal disposed between said pop-up stem and a mounting base on said housing; said seal comprising:

a grit wiper surrounding said pop-up stem and being disposed generally adjacent the top of said seal;

a central bearing arranged to slidingly engage said stem for guiding said reciprocation of said stem;

a pressure activated sliding seal adjacent to and below said central bearing, said sliding seal being arranged to bear against said stem in response to water pressure thereon; and an annular static seal below said sliding seal and arranged to cooperate with said stem to provide a watertight seal between said stem and said mounting base during operation of said sprinkler.

2. A seal as set forth in claim 1 further characterized in that said seal is formed as a unitary article and is secured to said mounting base.

3. A seal as set forth in claim 2 wherein said unitary seal is formed of a thermoplastic material which is molded in place on said mounting base.

4. A seal as set forth in claim 1 wherein said central bearing includes a plurality of raised pads which engage said pop-up stem in a circumferentially spaced relation to one another.

5. A seal as set forth in claim 1 further including a slot in said stem for temporarily permitting some water to leak past said water-activated seal during movement of said slot past said water-activated seal.

6. A seal as set forth in claim 1 wherein the exterior shape of said stem in transverse cross section is generally polygonal, and said grit wiper, said central bearing and said pressure-activated sliding seal are sized and shaped to conform and cooperate with said polygonal stem.

7. A seal as set forth in claim 6 wherein said annular static seal is generally conical and cooperates with a generally conical shoulder on said stem to form said watertight seal.

8. A seal as set forth in claim 6 wherein said polygonal shape is generally hexagonal.

9. A seal to be interposed between a moveable stem and a stationary housing in a pop-up type irrigation sprinkler, said seal assuming a fixed position with respect to said housing; said seal comprising:

means adjacent one end of said seal for wiping grit from an exterior surface of said stem during movement of said stem in a first direction;

a bearing adjacent said grit wiping means and arranged to slidingly engage said exterior surface of said stem; and means adjacent the opposite end of said seal for slidingly engaging said exterior surface of said stem and providing a seal between said stem and said housing during movement of said stem in a second, opposite direction.

10. A seal as set forth in claim 9 further including an annular static seal formed at said opposite end of said seal, and arranged to cooperate with said stem to provide a watertight seal between said stem and said housing when said stem has moved to its fullest extent in said second direction.

11. A seal as set forth in claim 9 further characterized in that said seal is a unitary article which is molded in place on said housing.

12. A seal as set forth in claim 9 wherein said means for wiping grit from said stem is a lip formed at said one end of said seal, projecting axially and radially inwardly from said seal with respect to said stem, and being sized and shaped to conform to the exterior shape of said stem.

13. A seal as set forth in claim 9 wherein said bearing includes a plurality of upstanding pads which engage said stem in a circumferentially spaced relation to one another.

14. A seal as set forth in claim 9 wherein said means for slidingly engaging said stem and providing a seal between said stem and said housing is a pressure-activated sliding seal which bears against said stem in response to water pressure thereon during movement of said stem in said second direction.

15. A seal as set forth in claim 9 wherein said exterior surface of said stem includes a slot therein for permitting water to leak past said sliding seal during movement of said stem in said second direction.

16. A seal as set forth in claim 14 wherein said stem has a generally polygonal shape in transverse cross section, and wherein said means for wiping grit, said bearing and said sliding seal are sized and shaped to conform to said polygonal stem.

17. A seal as set forth in claim 16 wherein said polygonal shape is generally hexagonal.

18. In a pop-up type irrigation sprinkler including a stationary housing containing an irrigation sprinkler mounted on a vertically movable stem, said stem being urged by a retraction spring to retain said sprinkler within said housing, and during operation of said sprinkler, said stem being urged by water pressure to move said sprinkler to an upwardly extended operating position; the improvement comprising:

a unitary seal molded in place on said housing and interposed between said housing and said stem, said seal including a lip projecting from said seal upwardly and inwardly with respect to said stem, a central bearing adjacent said lip arranged to slidingly engage said stem, a pressure-activated sliding seal adjacent said bearing on the opposite side of said bearing from said lip, said sliding seal being arranged to bear against said stem in response to water pressure thereon during movement of said stem from said retracted position toward said operating position, and an annular static seal at the end of said seal opposite said lip, said static seal being arranged to cooperate with a shoulder on said stem to provide a water-tight seal between said housing and said stem when said stem is in said operating position.

19. The improvement as set forth in claim 18 wherein the external shape of said stem is polygonal in transverse cross section, and said lip, said bearing, and said sliding seal are sized and shaped to conform to the polygonal shape of said stem.

20. The improvement as set forth in claim 19 wherein said polygonal shape is generally hexagonal.

21. The improvement as set forth in claim 18 wherein said bearing includes a plurality of raised pads arranged to slidingly engage said stem, said pads being circumferentially spaced from one another.

22. The improvement as set forth in claim 18 wherein the exterior surface of said stem includes a slot for permitting water to pass under said sliding seal when said slot passes said sliding seal during movement of said stem from said retracted position to said operating position.

* * * * *

REEXAMINATION CERTIFICATE (339th)

United States Patent [19] [11] B1 4,316,579

Ray et al. [45] Certificate Issued Apr. 16, 1985

[54] MULTI-PURPOSE SEAL FOR POP-UP SPRINKLER

[75] Inventors: Charles A. Ray, Arcadia; John L. Kent, Ontario, both of Calif.

[73] Assignee: Anthony Manufacturing Company, Azusa, Calif.

Reexamination Request:
No. 90/000,592, Jul. 12, 1984

Reexamination Certificate for:

| | |
|---|---|
| Patent No.: | **4,316,579** |
| Issued: | **Feb. 23, 1982** |
| Appl. No.: | **138,868** |
| Filed: | **Apr. 11, 1980** |

[51] Int. Cl.[3] ..... B05B 15/10

[52] U.S. Cl. ..... 239/123; 239/205; 239/206; 277/24; 277/27; 277/152; 285/110; 285/302

[56] References Cited

U.S. PATENT DOCUMENTS

| | | | |
|---|---|---|---|
| 3,523,647 | 8/1970 | Radecki | 239/206 |
| 3,713,584 | 1/1973 | Hunter | 239/206 |
| 3,716,192 | 2/1973 | Hunter | 239/205 |
| 3,724,757 | 4/1973 | Hunter | 239/205 |
| 3,735,772 | 5/1973 | Hunter et al. | 137/15 |
| 3,874,588 | 4/1975 | Flynn | 239/206 |
| 3,934,820 | 1/1976 | Phaup | 239/205 |
| 4,234,125 | 11/1980 | Lieding | 239/205 X |

FOREIGN PATENT DOCUMENTS 2201718 7/1973 Fed. Rep. of Germany .

*Primary Examiner*—Andres Kashnikow

[57] ABSTRACT

For use with a pop-up sprinkler of the full or part circle type, a multi-purpose seal is provided between the movable stem of the pop-up sprinkler and a stationary mounting base which is fixed with respect to the sprinkler housing. The seal is preferably a unitary molded article and includes a grit wiper at its upper end, a central bearing to slidingly guide the stem within the housing, a sliding water-activated seal, and an annular static seal for providing a watertight seal between the movable stem and stationary housing during normal operation of the sprinkler.

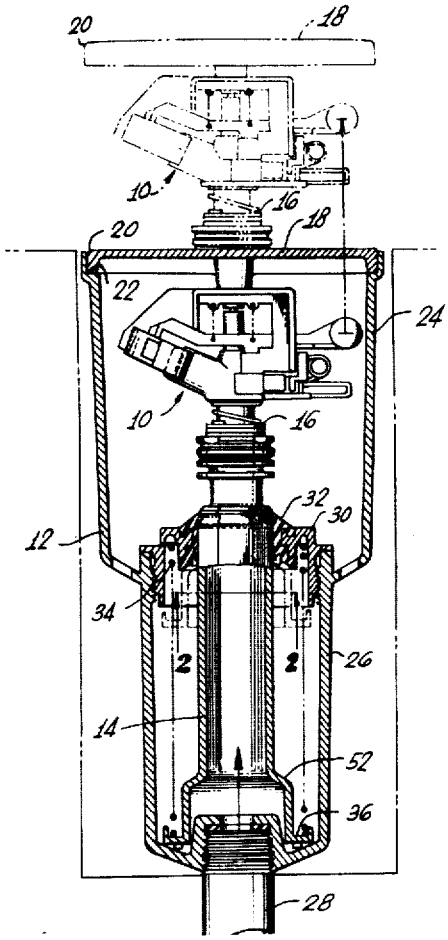

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–8 and 18–22 is confirmed.

Claim 9 is determined to be patentable as amended.

Claims 10–17, dependent on an amended claim, are determined to be patentable.

9. A seal to be interposed between a moveable stem and a stationary housing in a pop-up type irrigation sprinkler, said seal assuming a fixed position with respect to said housing; said seal comprising:

means adjacent one end of said seal for wiping grit from an exterior surface of said stem during movement of said stem in a first direction;

a bearing adjacent said grit wiping means and arranged to slidingly engage said exterior surface of said stem; and

*pressure-responsive* means adjacent the opposite end of said seal for slidingly engaging said exterior surface of said stem and providing a seal between said stem and said housing during movement of said stem in a second, opposite direction.

* * * * *